US005626672A

United States Patent [19]

Rossetti

[11] Patent Number: 5,626,672

[45] Date of Patent: May 6, 1997

[54] DECORATING ROLLER FOR PRODUCING CONTRAST EFFECTS SUCH AS THOSE PRODUCED WITH PADS

[75] Inventor: Edoardo Rossetti, Finale Emilia, Italy

[73] Assignee: SPETRA S.R.L., Modena, Italy

[21] Appl. No.: 256,857

[22] PCT Filed: Jan. 25, 1993

[86] PCT No.: PCT/EP93/00157

§ 371 Date: Nov. 28, 1994

§ 102(e) Date: Nov. 28, 1994

[87] PCT Pub. No.: WO93/14879

PCT Pub. Date: Aug. 5, 1993

[30] Foreign Application Priority Data

Jan. 27, 1992 [IT] Italy ..... MO92A0008

[51] Int. Cl.[6] ..... B05C 1/00

[52] U.S. Cl. ..... 118/258; 118/264; 118/DIG. 15; 15/230.11; 15/230.16; 15/230.17

[58] Field of Search ..... 118/102, 258, 118/262, 264, 266, 269, DIG. 15; 401/96; 492/28, 33, 36; 15/210.5, 217, 230.11, 230.16, 230.17; 427/428

[56] References Cited

U.S. PATENT DOCUMENTS

| | | | |
|---|---|---|---|
| 1,003,647 | 9/1911 | Piper | 15/230.16 |
| 3,536,037 | 10/1970 | Mortellito | 15/230.11 |
| 4,244,074 | 1/1981 | Barcikowski et al. | 15/114 |
| 5,127,123 | 7/1992 | Belanger | 15/230.16 |

FOREIGN PATENT DOCUMENTS

| | | |
|---|---|---|
| 0302662 | 2/1989 | European Pat. Off. . |
| 0406514 | 1/1991 | European Pat. Off. . |
| 553522 | 11/1943 | United Kingdom . |
| 604630 | 8/1948 | United Kingdom . |

*Primary Examiner*—Laura Edwards
*Attorney, Agent, or Firm*—Trask, Britt & Rossa

[57] ABSTRACT

The paint or decorating roller, which is intended to produce contrast effects with substantially unevenly-distributed impressions, such as those produced with pads, without showing an undesirable tendency to slip, is constituted by an array of flexible tuft-like decorating elements (2, 9, 19) which are fixed permanently or removably to the outer surface of the roller body (1, 15, 2 1) which is coupled for rotation on the straight front portion of a respective support arm (4, 17, 25), each tuft being formed by the pleating along at least two intersecting lines of an inner, central region of a flat piece of fabric, hide or other material having a regular or preferably even an indented outline; the roller is for use in the painting and decorating field in general.

10 Claims, 5 Drawing Sheets

DECORATING ROLLER FOR PRODUCING CONTRAST EFFECTS SUCH AS THOSE PRODUCED WITH PADS

FIELD

The invention relates to a paint or decorating roller. In particular, the present invention has been developed with the aim of providing a roller for producing contrast effects such as those produced with pads, that is, a new tool for producing impressions on walls or other freshly-painted surfaces or for painting impressions on a wall, the impressions being o:f the type which up to now could only be produced by means of pads made of absorbent fabric, squeezed manually by the painter.

STATEMENT OF THE ART

The prior art includes European patent application EP-302662 which, in order to achieve decorative effects, for breaking the continuity of a coat of paint applied to the surface to be painted, provides for a decorating tool constituted by a roller to the outer surface of which are fixed flat appendages with continuous, flexible, longitudinal portions which have cross-sections like open "V"s and are inclined to the axis of the roller at an angle of between 0° and 50°, the inner end of each portion being connected to the outer surface of the roller and its outer ends being free.

The prior art also includes British patent 60463.0, which provides for a decorating tool constituted by a roller supported rotatably by a grip with a forked end constituted by a core on which are force-fitted small irregular rings each formed by a bent triangular strip which is perforated in correspondence with the axis of the roller, to form an uneven, roughly cylindrical, outer surface; this produces a surface decorated with motifs such as wavy, substantially parallel stripes, in order to simulate, for example, a wood grain.

The prior art also includes European patent application EP-A-0 406 514 which provides for a painting roller having a roller body carrying a plurality of resilient elements fitted thereon so as to create a paint pattern when the edges of the resilient elements are thrown by a centrifugal force, during the rotation of the roller body, on the surface to be painted.

The prior art also includes British patent 553522 which provides for a decorating roller, the outer surface of which has an array of parallel helical grooves, in each of which the inner edge of a longitudinal strip is inserted, the strip having transverse cuts in its outer edge to define equally-spaced, substantially radial appendages which are intended to interfere with the surface to be decorated in order to break the continuity of the coat of paint spread thereon; the effects which can be produced are mainly of the type which simulates striped wallpaper.

Finally, the prior art includes U.S. Pat. No. 3,536,037 which provides for flat, resilient, flexible flaps projecting radially from the outer lateral surface of a decorating roller of cylindrical or bi-frustoconical shape with opposed larger bases; this is mainly to achieve a droplet effect.

The decorating tools of the patents mentioned above do not, however, enable variegated or contrasting effects affecting regions of non-uniform sizes which are not distributed in a precisely repetitive manner to be produced satisfactorily on a freshly-painted surface or, at any rate, a surface in the course of being painted, so as to simulate impressions executed by hand by means of a pad.

In fact, as regards the decorating tool of the European patent 302662, it should be stated that this has an undesirable tendency to slip on the surface to be painted, particularly when coats of paint of considerable thickness have been applied; this involves undesirable and unpredictable changes in the aesthetic effect.

Moreover, the tool of the British patent 604630 is unsuitable for mass production since it is necessary to prepare the strips in which pluralities of aligned holes have to be formed, and then to bend the portions before they are driven onto the respective core; this involves considerable assembly difficulties.

Furthermore, with the rollers of the British patent 553522 and the U.S. Pat. No. 3536037, which have substantially symmetrical flaps or appendages, a user who wishes to form a decoration with irregular impressions has to pass the roller over the same portion several times in different directions; this involves a considerable waste of time and reduction in productivity. moreover, these rollers, particularly those with very resilient flaps, show an undesirable tendency for the ends of the flaps to spray the paint towards the user when they pass the positions in which they are restrained on the wall during rolling.

The effect produced with a pad can thus still be produced only manually with the use of skilled labour and hence at considerable cost.

The prior art can be improved upon considerably with regard to the possibility of eliminating the problems indicated above.

It can be seen from the foregoing, that there is a need to solve the technical problem of finding a decorating tool which can produce separate, contrasting or variegated decorations or even marks on freshly-painted surfaces or perhaps on surfaces in the course of being painted, by softening the tone of the same shade or possibly by applying different colours superimposed on a base coat so as to simulate the effect produced manually with pads or by parchment paper: the decorating elements must be suitable for producing substantially separate impressions which are slightly different for each revolution, according to the way in which the roller is used; it is also necessary to provide a decorating roller which is suitable for use even on quite dense and/or thick coats of wet paint, without showing an undesirable tendency to slip, and which can also produce decorative effects which differ from each other significantly, for example, changing from a decoration of widely-spaced impressions or marks to a densely-marked decoration, all at a low cost.

SUMMARY OF THE INVENTION

The invention overcomes the aforesaid technical problem with the use, on the body of a roller which, to advantage, is of spongy or woollen or, in any case, absorbent material, of a peripheral array of decorating elements which may or :may not be arranged in lines and each of which is constituted by at least one flexible raft or calyx-like element, the tip region of each element being connected to the outer surface of the roller body. In the present invention it is possible for each tuft-like or calyx-like decorating element to be formed by the pleating and/or squeezing of an inner, conveniently central, region of a flexible piece of tape or sheet or a piece of material which, to advantage, is absorbent, having an outline which is regular or indented in plan, in order to raise its edge, possibly unevenly or asymmetrically. In one possible embodiment, the tuft element, the tip of which is connected to the body of the roller, projects radially from the outer surface of the roller without interfering or, in any case, without greatly interfering with the edges of adjacent rafts, the extent of each tuft being less than the length of the roller.

The advantages achieved by the invention are: that it is possible to produce irregular, asymmetrical, non-repetitive, decorative impressions or even marks occupying substantially randomly distributed regions of the surface to be coated; this is due mainly to the different way in which each tuft-like decorating element contact the surface to be decorated with each rotation as a result, amongst other things, of the unpredictable interaction between the portions of each tuft and between these and the surface itself; that it can easily and readily be operated even by unskilled personnel, such as, for example, non-professional users, with the certainty of achieving the desired result; that there is a considerable reduction in the tendency of the roller to stick on the wet surface to be treated and in the resulting undesirable slippages, due to the radial solidity of the tuft-like decorating elements which can withstand radial forces exerted during rolling so that there is preferential contact between the edges of the tufts and the paint, preventing adhesion forces, which would hinder rolling, from arising between the decorating elements and the wall; that it is possible to vary the, decorative effects which can be achieved with the same roller body simply by changing the number and/or distribution of the calyx-like or tuft-like decorating elements; and that it is cheap.

BRIEF DESCRIPTION OF THE DRAWINGS

An embodiment of the invention is illustrated, purely by way of example, in the five appended sheets of drawings in which.

DETAILED DESCRIPTION OF THE ILLUSTRATED EMBODIMENTS

Figure 1:
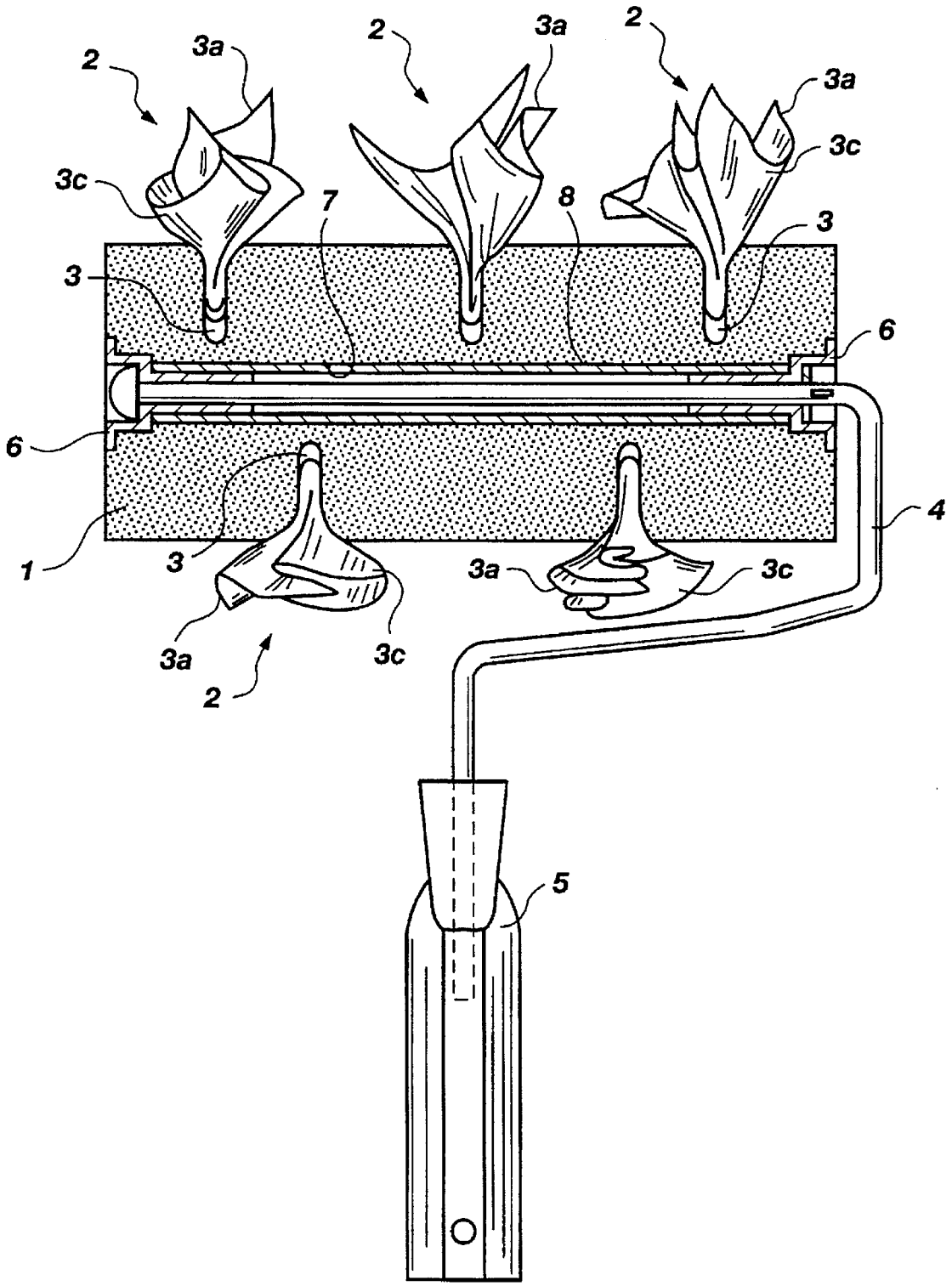
FIG. 1 is a partially-sectioned front view of the tool with a roller and separate calyx-like or tuft-like decorating elements applied to the body of the roller itself, according to the invention, this embodiment having a rotatable, deformable body, for example, of spongy material.
Figure 2:
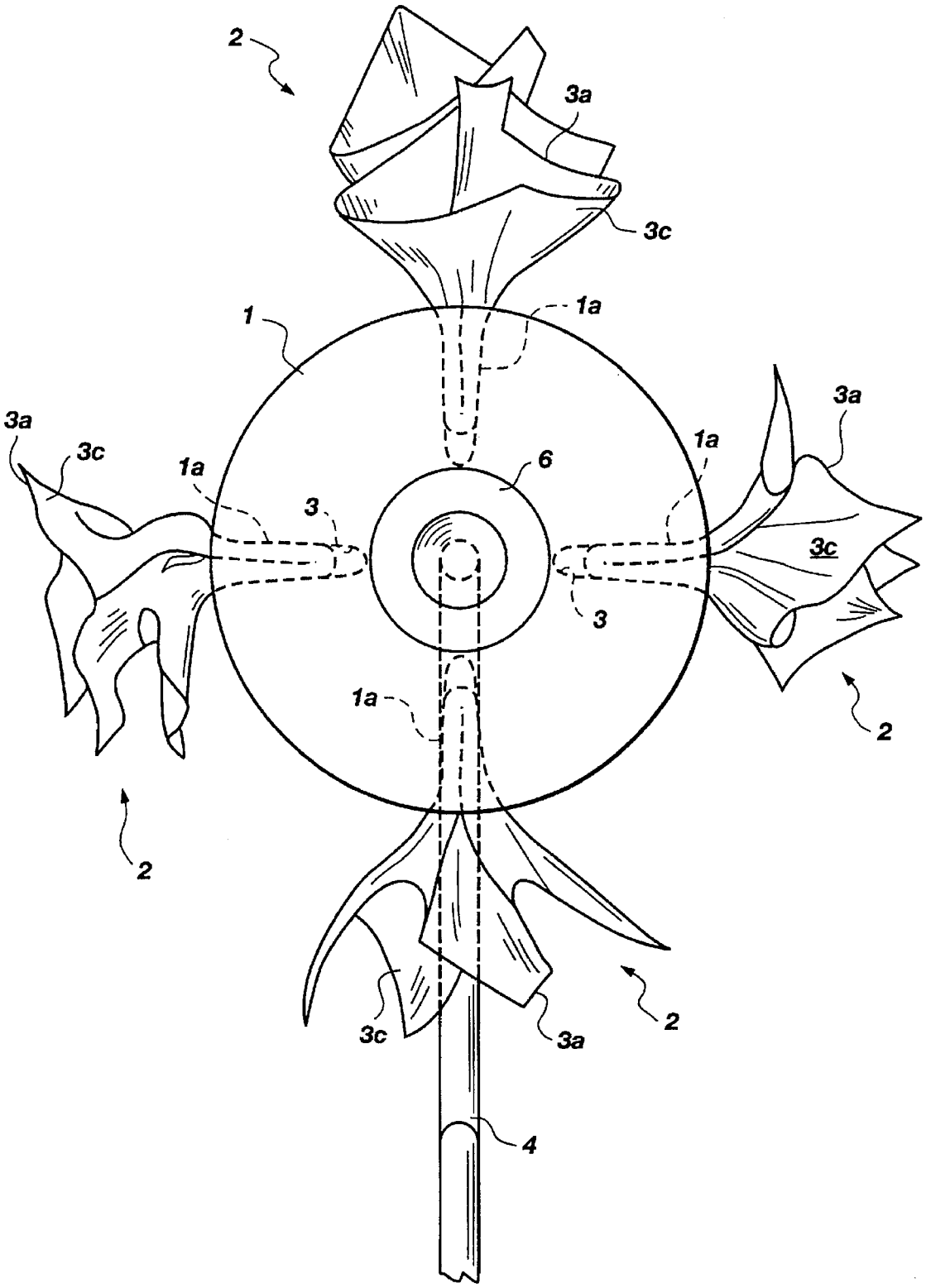
FIG. 2 is a partial side view of the tool of FIG. 1, on an enlarged scale.
Figure 3:
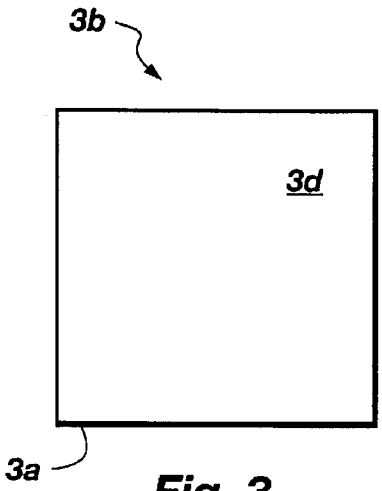
FIGS. 3, 4, 5, 6 and 7 are plan views of square, rectangular, circular, star-shaped and cross-shaped pieces of fabric or absorbent sheet, respectively, suitable for being inserted radially like calices in the body of the roller after their central regions have been pleated.
Figure 4:
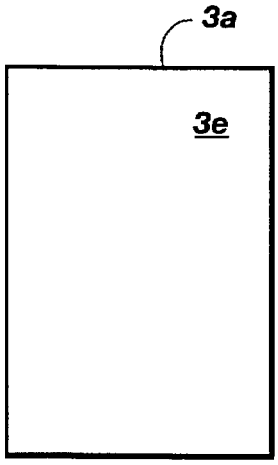
Figure 5:
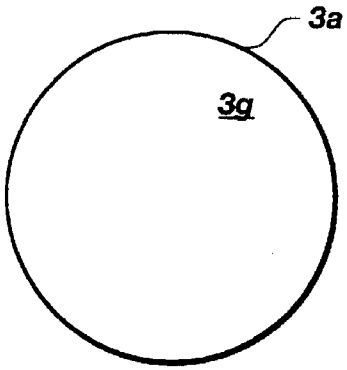
Figure 6:
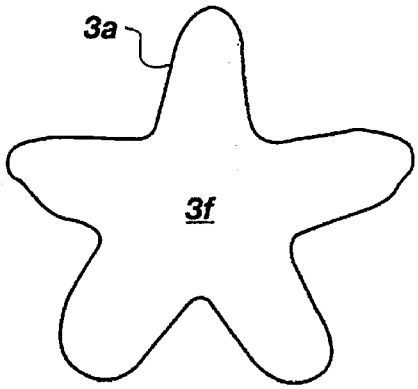
Figure 7:
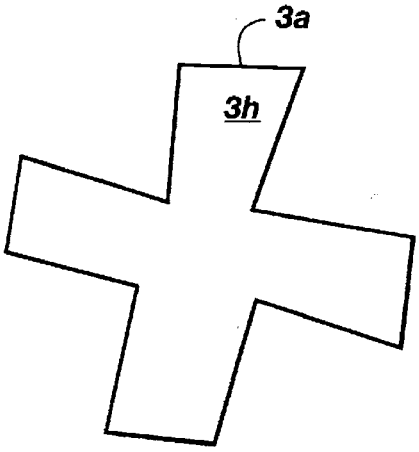
Figure 8:
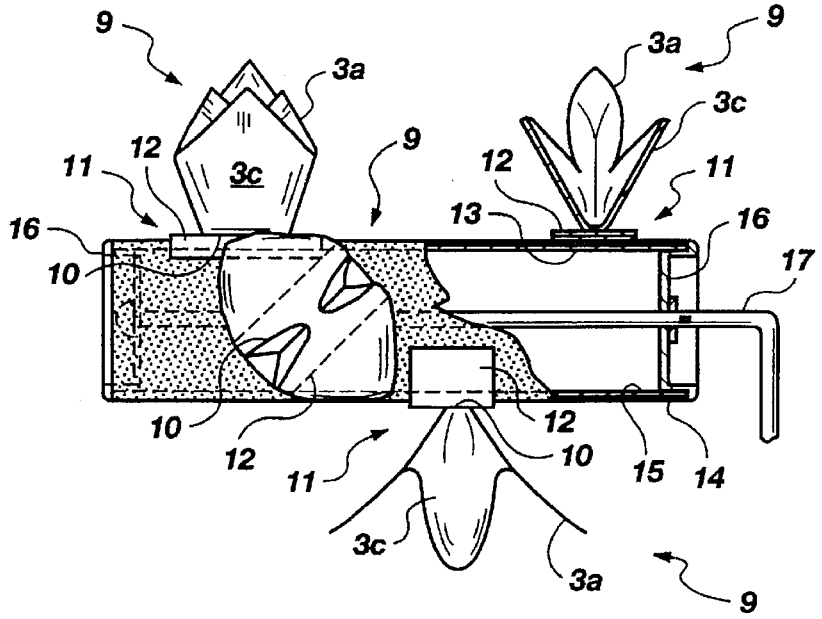
FIG. 8 is a partially-sectioned, partial side view of an embodiment of the roller according to the invention having removable tuft-like decorating elements.
Figure 9:
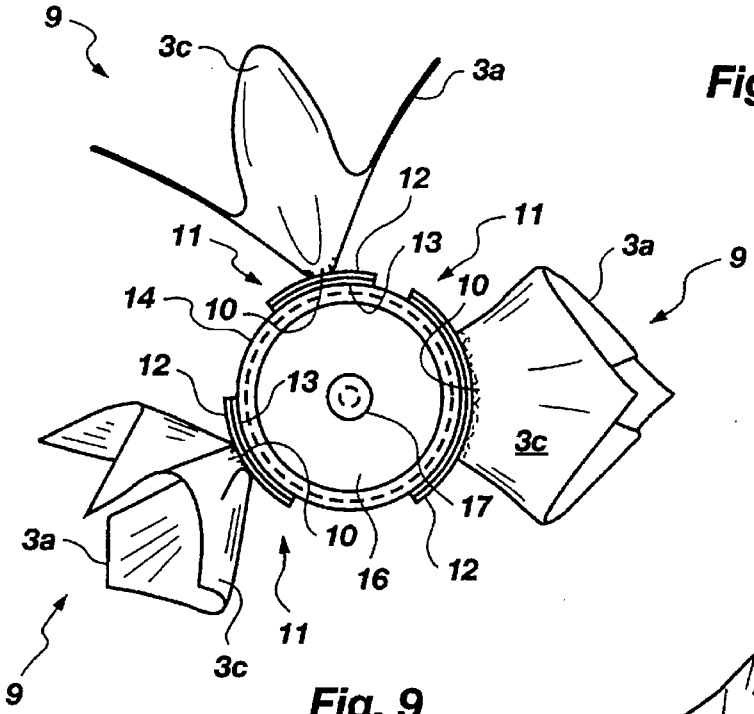
FIG. 9 is a view of FIG. 8 from the left-hand side and on an enlarged scale.
Figure 10:
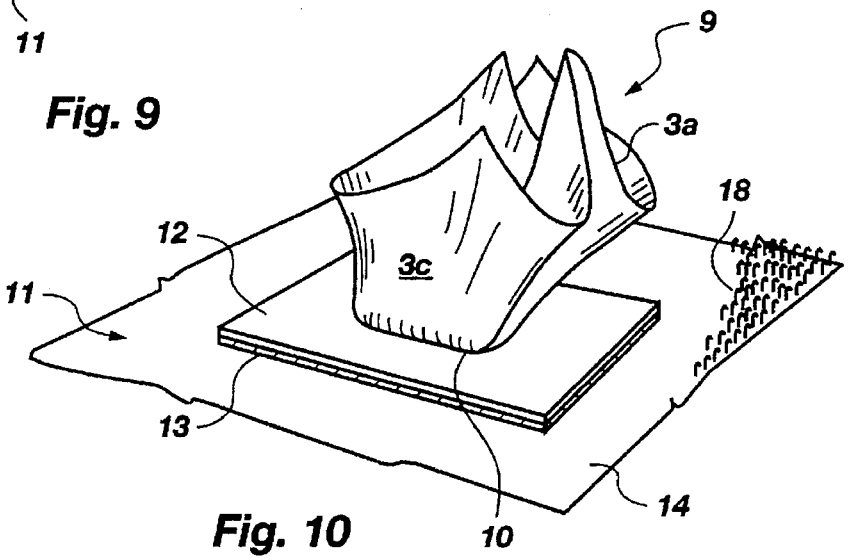
FIG. 10 is a perspective view of a removable tuft-like decorating element and its support, on an enlarged scale.
Figure 11:
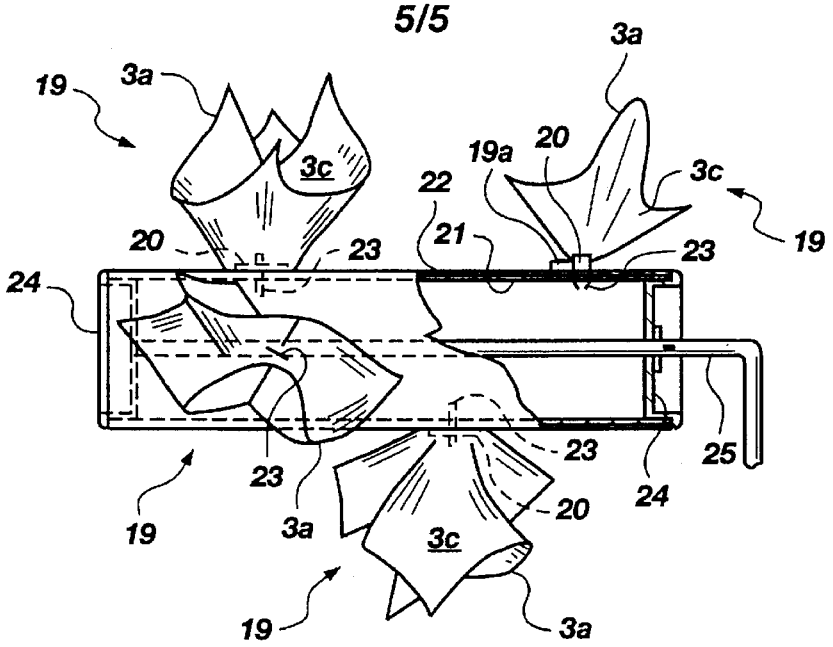
FIG. 11 is partially-sectioned partial side view of an embodiment of a roller according to the invention having tuft-like decorating elements which are fixed by stapling.
Figure 13:
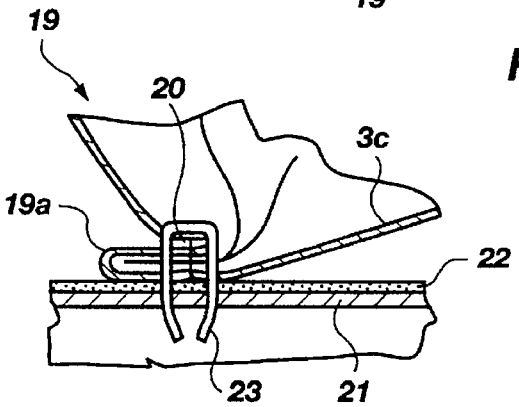
FIG. 13 is a partial view showing a detail of the tip of a tuft-like decorating element of FIG. 11, sectioned and on an enlarged scale.
Figure 12:
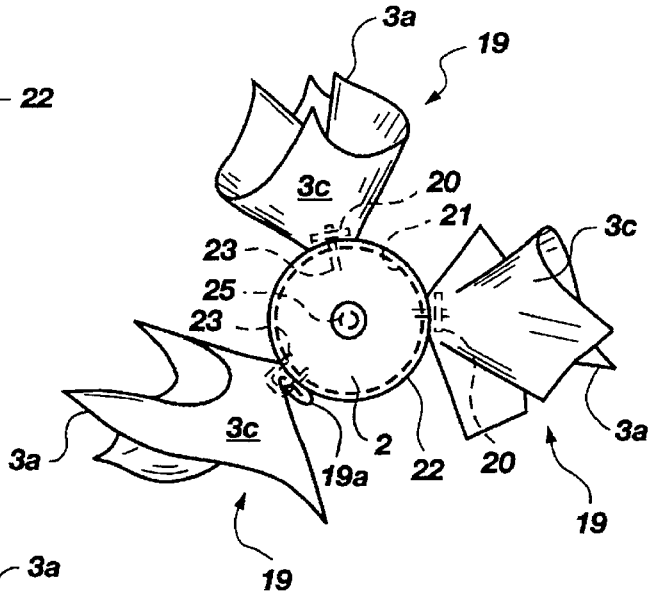
FIG. 12 is a view of FIG. 11 from the left-hand side.
Figure 14:
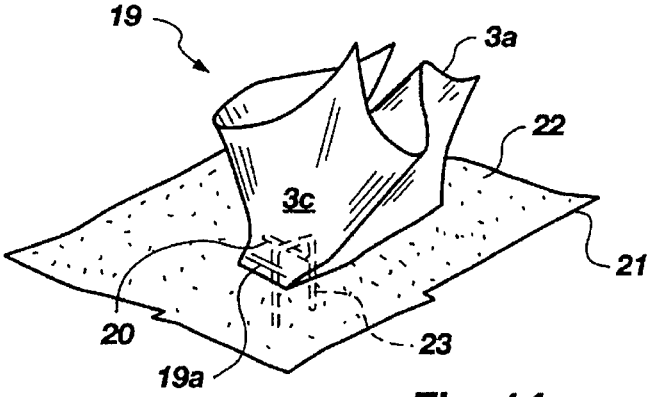
FIG. 14 is a perspective view showing, on an enlarged scale, a tuft-like decorating element which is fixed to the body of the roller by stapling.

The drawings show a roller body, indicated 1, which, to advantage, is of a spongy or absorbent material, for example, expanded PVC, expanded polyurethane, acrylic, polyamide, or woollen fabric, or the like, with a diameter of from a few centimeters up to about ten centimeters or more, and in the; periphery of which the tips 1*a* of tuft-like or calyx-like decorating elements 2 are inserted in respective blind holes 3 in order to be fixed therein by gluing; each raft has curled or, in any case, raised edges because an inner region of the flat element from which it is formed has been pleated or squeezed, even tangentially, along at least two lines which, to advantage, intersect; the regular, or possibly indented, outline of each piece 3*b* of fabric, cloth, hide, or synthetic material, or tape constituting the flat shape of the respective tuft is indicated 3*a*; the portions which project radially from the surface of the roller in very varied and variously intersecting spatial orientations are indicated 3*c*; pieces, sheets or tapes having square, rectangular, circular, star-shaped and cross-shaped outlines are indicated 3*d, e, f, g* and *h*, respectively; the maximum dimensions of the pieces may be from a few centimeters event up to about ten centimeters or more, the proportions of the length and the width of each piece or each element being widely variable even, to advantage, to define a high ratio in order to produce a considerable degree of non-uniformity in the decoration; a support arm 4 with a curved axis has a straight front portion on which the body of the roller 1 can be coupled for rotation, and which is connected by a "U"-shaped side portion to a rear portion which is perpendicular to the axis of the roller and on which a grip 5 is force-fitted; two bushes fitted in opposite end portions of the longitudinal hole 7 which extends through the roller are indicated 6 and are interconnected by a tubular spacer element 8, for example, of wood, metals, cardboard or plastics material, such as polypropylene, or another plastics material, for supporting the roller for rotation in correspondence with the end portions of the upper straight portion of the arm 4; the axial length of the roller may be between about 5 cm and about 30 cm, the shorter lengths relating to rollers for finishing corners; tuft-like decorating elements, indicated 9, are produced by the pleating like a bellows of a piece, for example, a square piece, and sewing its tip 10 to a support 11 constituted by the back of a fabric element 12 which has a woolly lower layer 13 for fixing to the layer 14 covering the outer surface of the cylindrical body 15 which is coupled for rotation on the front straight portion of the respective support arm 17 by means of a pair of end pieces 16; an array of elements, indicated 18, each having an upwardly-facing, flexible, hook-like profile, projects perpendicularly from the layer 14 for anchoring the woolly covering 13 removably thereto; the layer 14 and the respective anchoring elements 18 and the layer 13 together constitute a micro-hook coupling device in form of a fabric with two separable layers known commercially by the name of "Velcro" (Trademark); tuft-like decorating elements, indicated 19, are also produced by the bellows-like pleating of pieces, for example, square pieces, but have tips 19*a* which are pleated by means of a clip 20 for holding the pleat in place; the clip 20, which is in contact with the outer surface 21 of the roller, which may be covered by a thin layer 22 of soft material, is fixed to the roller by means of a radial anchoring staple 23 which is driven into the body of the roller itself from inside the respective tuft 19; two end pieces, indicated 24, define the axial length of the roller 21 and couple it for rotation on the straight front end portion of the support arm 25.

The roller is used in the following manner; a base layer of paint is in any case spread on the surface to be decorated and, before it has dried, the body of the roller 1, 15, 21 is urged against the surface and the axis of the roller is moved in a plane substantially parallel to the surface thus squeezing the calyx-like or tuft-like decorating elements 2, 9, 19 against the surface to be decorated in order to cause their edges to roll on the wall without appreciable slippage; this alters the coat of paint producing irregular thicker and thinner portions constituting impressions or marks; a variation of the pressure of the roller against the wall intensifies the contrast between the lighter base colour and the darker regions of the edges of the impressions.

Alternatively, it is possible to apply a coat of finishing paint, possibly of a different colour to the wall, which again is to be painted or already has a film of paint constituting the base colour, possibly decorated with irregular impressions as indicated above, by operating the roller in the manner described above after it has been immersed in the liquid paint.

In practice, the details of execution, the dimensions and the materials may differ from those indicated, but will be technically equivalent thereto, without thereby departing from the scope of the present invention.

Thus, in the embodiment with fixed connections, the calyx-like or tuft-like decorating elements may also be sewn directly to the outer surface of the roller or joined thereto by rivets or nails or even by split pins; as regards the removable connections, these may also be formed, for example, by buttons, so-called press-studs, or even removable connections of another type.

Moreover, each tuft-like or calyx-like decorating element may be constituted by two or more concentric layers or by at least two tufts side by side with their tips converging at the periphery of the roller body.

Finally, as regards the distribution of the decorating elements, which may even be staggered, they may be aligned along generatrices of the roller or may be in helical or other convenient arrangements.

I claim:

1. A decorating roller comprising:

a roller body, rotatably connected to a support structure;

decorating elements projecting from a peripheral surface of the roller body, each decorating element being connected to said roller body at a respective tip region of said decorating element, at least one decorating element (2, 9, 19) being formed by folding a flexible flat element along at least two lines of an inner region of said flexible flat element so that said at least one decorating element has an edge raised in a calyx-shaped tuft.

2. The roller according to claim 1, wherein said at least two lines intersect.

3. The roller according to claim 1, wherein said decorating elements (9) are produced by the pleating like a bellows of said flexible flat element.

4. The roller according to claim 1, wherein said edge (3*a*) is unevenly raised.

5. The roller according to claim 1, wherein the decorating elements (2, 9, 19) are distributed on an outer surface of the roller body (1) in a manner such that interference between said edges of adjacently positioned said decorating elements is substantially prevented, the extent of each tuft being less than a length of the roller body.

6. The roller according to claim 1, wherein the roller body (1) is fabricated of an absorbent material, the tip region (1*a*) of each decorating element (2) being inserted in and fixed to a respective radial hole (3) defined in the roller body (1).

7. The roller according to claim 1, wherein the roller body (1) is at least partially covered by a layer of fabric (14) having a continuous uniform array of anchoring elements, each said anchoring element having a flexible, hook-like profile (18) projecting radially outwardly for removable connection to a corresponding woolly layer (13) on a lower face of a flat element (12) for supporting the said decorating element (9); the tip region (10) of said decorating element being connected to a backside of the flat element (12).

8. The roller according to claim 1, wherein the tip region (10) of each said decorating element (19) is fixed, by means of at least one of a staple and nail to an outer surface of the roller body (1).

9. The roller according to claim 8, wherein the tip region (19*a*) of the decorating element (19) has a transverse clip (20) which holds a pleat in place and which is fixed to the roller body (1) by said staple (23) which is driven radially into the roller body from inside a tuft of said decorating element.

10. The roller according to claim 1, wherein the support structure comprises an arm (4) with a curved axis having a linear, front portion (17) rotatably supporting said roller body (1), said front portion constituting a side arm of a "U"-shaped portion of the support structure, another side arm of said support structure being connected to a rear portion on which a grip (5) is force-fitted.

* * * * *